United States Patent [19]

Howard

[11] Patent Number: 4,903,555

[45] Date of Patent: Feb. 27, 1990

[54] AUTOMATICALLY ADJUSTABLE MODERN PIPE WRENCH

[75] Inventor: Carl B. Howard, Bakersfield, Calif.

[73] Assignee: Nowata Agricultural Management Co., Inc., Bakersfield, Calif.

[21] Appl. No.: 305,615

[22] Filed: Feb. 3, 1989

[51] Int. Cl.[4] ..... B25B 13/14

[52] U.S. Cl. ..... 81/145; 81/137

[58] Field of Search ..... 81/134, 135, 137, 145, 81/148, 154

[56] References Cited

U.S. PATENT DOCUMENTS

| | | | |
|---|---|---|---|
| 864,155 | 8/1907 | Carter . | |
| 994,070 | 5/1911 | Fields et al. . | |
| 1,027,203 | 5/1912 | Halverstadt . | |
| 1,064,361 | 6/1913 | Moak . | |
| 1,176,328 | 3/1916 | Tressler | 81/137 X |
| 1,181,380 | 5/1916 | Gorder . | |
| 1,199,806 | 10/1916 | Merritt . | |
| 1,282,223 | 10/1918 | Hall | 81/145 |
| 1,289,937 | 12/1918 | Shade | 81/145 |
| 1,336,460 | 4/1920 | Woodward . | |
| 1,362,845 | 12/1920 | Carr | 81/145 X |
| 1,377,930 | 5/1921 | Roach | 81/137 |
| 1,445,531 | 2/1923 | Persinger . | |
| 3,039,338 | 6/1962 | Borg | 81/134 |
| 4,144,779 | 3/1979 | Honick | 81/145 X |
| 4,358,972 | 11/1982 | Tuell | 81/148 X |

*Primary Examiner*—James G. Smith

*Attorney, Agent, or Firm*—James C. Fails; Arthur F. Zobal; Geoffrey A. Mantooth

[57] ABSTRACT

A pipe wrench that is readily fitted to a desired size by engagement of rack-like teeth on a stem portion with a movable jaw with co-engaging rack-like teeth, the pipe wrench being of a modern type and including means for retrofitting conventional modern pipe wrenches.

1 Claim, 3 Drawing Sheets

AUTOMATICALLY ADJUSTABLE MODERN PIPE WRENCH

FIELD OF THE INVENTION

This invention relates to pipe wrenches. More particularly, this invention relates to pipe wrenches that are automatically adjustable and do not require rotation of a nut to slide a jaw into fitting engagement with a pipe or the like.

BACKGROUND OF THE INVENTION

The prior art has seen a wide variety of approaches to forming automatically adjustable pipe wrenches. The closest art of which I am aware is U.S. Pat. No. 4,144,779 which shows that nut adjusted pipe wrenches are old. That patent then describes a way of employing an old style pipe wrench with rack-like teeth on the back of the stem in combination with a groove and a tiltable rocking-sleeve mechanism for automatically positioning the jaw.

A search of the prior art also reveals additional pertinent patents ranging from U.S. Pat. No. 864,155 which shows laterally movable dogs that move responsive to an engageable lateral member that can be broken by thumbs or the like to allow the dogs to be released, through U.S. Pat. No. 1,445,551 which shows a wrench that has rack-like teeth on the front of a handle that are engaged by dog-teeth on movable jaw. In between are similar patents; such as, a monkey wrench described in U.S. Pat. No. 994,070 in which teeth on a movable jaw are pivoted out of and into engagement with teeth on the handle; and U.S. Pat. No. 1,027,203 in which teeth on a movable jaw are pivoted by depression of push-button into and out of engagement with teeth on a handle. U.S. Pat. No. 1,181,380, 1916, describes biased teeth that are pivotally mounted to a movable jaw and can be clamped into engagement with teeth on a handle by hands or the like. U.S. Pat. No. 1,199,806 describes teeth on a movable jaw or the like. U.S. Pat. No. 1,199,806 describes teeth on a movable jaw that can be moved into or out of engagement with teeth on a handle. U.S. Pat. No. 1,336,460 describes a means of moving teeth on a movable jaw into engagement with teeth on a handle or the like, as does U.S. Pat. No. 1,064,361, the latter employing pivotally mounted biased teeth for large or fine engagement with teeth on the handle.

Thus the prior art shows that the principles are old in this crowded art; but the art has failed to provide a modern type pipe wrench in which the upper jaw is movable through a sleeve and has a slider block for clamping the stem along its side to retain an attained position, or fit; and that can be retrofitted onto existing pipe wrenches.

DESCRIPTION OF PREFERRED EMBODIMENT

Accordingly, it is an object of this invention to provide a modern pipe wrench that can be retrofitted to existing pipe wrenches, that has a movable upper jaw with a stem portion that slides through a sleeve and has a slider block that can be moved into engagement with teeth in the side of the stem, all different structure from that provided priorly in this crowded art.

It is also an object of this invention to provide rack-like teeth on the side of the stem with the holding means portion that is a part of the wrench having co-engaging pivotally mounted dogs containing mating teeth blocks that are adapted to co-engage the teeth along the sides of the stems, all operated with a single hand once the desired positions, or fit, is attained.

These and other objects will become apparent from the descriptive matter hereinafter, particularly when taken into conjunction with the appended drawings.

DESCRIPTION OF PREFERRED EMBODIMENTS

Figures 1, 2A, 2B, 2C:
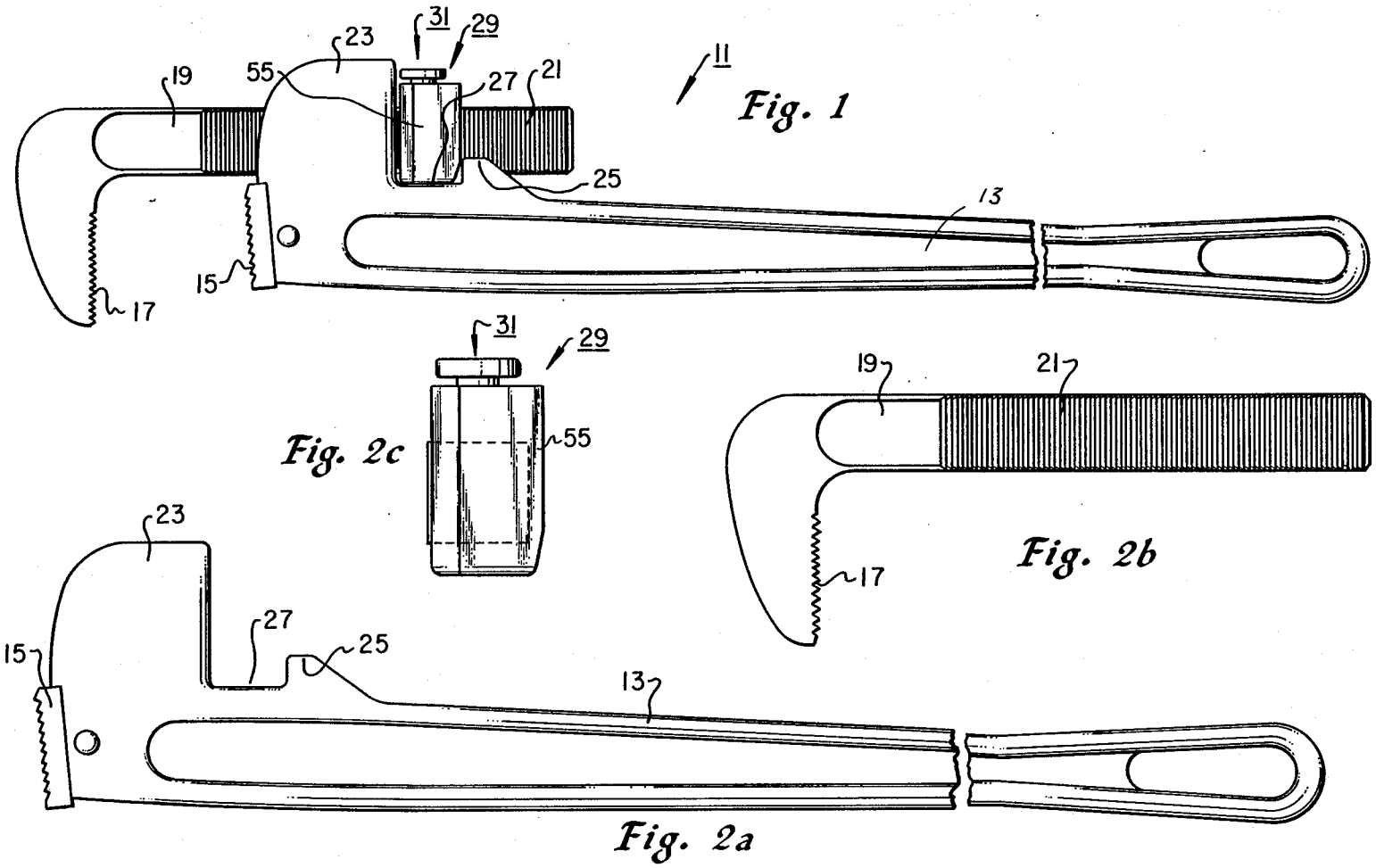
FIG. 1 is a front elevational view from the side of a modern pipe wrench having all of the elements assembled.
FIG. 2*a* is a front elevational view of the handle of the pipe wrench of FIG. 1.
FIG. 2*b* is a front elevational view of the upper jaw with the integrally mounted slidable stem portion.
FIG. 2*c* is a side elevational view of a slider block in which the push-button is illustrated.

Referring to FIGS. 1–2*c*, the wrench 11 includes a movable upper jaw 17 with a depending stem portion 19 extending downwardly along the backside of the handle 13.

The stem includes a first portion 21 of a holding means for holding an attained position of the stem with respect to the lower jaw, or lower jaw portion, 15. The wrench 11 also includes a sleeve portion 23 rigidly connected with the handle below the lower jaw, the sleeve having space for the stem portion to pass slidably therethrough. As can be seen most clearly in FIGS. 1 and 2*a*, the wrench also has an upwardly protruding shoulder 25 disposed below the sleeve portion 23 and defining a slider box clearance space 27. The wrench 11 also includes a second portion 29, FIGS. 1 and 2*c*, of the holding means for achieving an attained position; and a releasing means 31 for releasing the stem portion from the second portion of the holding means to enable an operator to depress the releasing means and quickly and easily attain a desired fit with the wrench 11.

The handle 13 may be formed of any suitable material. Based upon normal jobs to do, requiring relatively high level of strength, the handles have heretofore been formed of metal. Typical are those molded from iron-containing metals, such as pig-iron, and even steel, components. In certain industries where non-sparking is a requirement, the handle may be formed of cast aluminum, magnesium or the like that does not create sparks and can be used in explosive environments. It is relatively immaterial to this invention what type of handle is employed. The handle should contain a lower jaw portion, such as jaw 15.

The jaw 15 may be integrally formed into the handle or it may be a suitable separate detachable element of hardened steel or the like for greater assist in gripping the object to be gripped once the desired position is attained. If such a separable element is employed, it may be fixed by any of the usual methods such as screws or the like. Frequently, it is helpful if the lower jaw portion 15 includes a separate loosely attached jaw element with teeth that are formed of hardened steel or the like that can be employed to engage the object, such as a pipe, to be engaged when the attained position is achieved, as for rotating for breaking loose a connection, tightening a connection or the like.

Similarly, the upper jaw 17 will have teeth for engaging the object. The upper jaw may also have a separate upper jaw teeth portion, if desired. Frequently, however, the upper jaw portion is integrally formed with its stem portion 19 so as to be slidable therewith. Because of the relatively low expense in forming this item, it is frequently advantageous to simply form the teeth into the upper jaw portion and have it replaceable when worn, along with the stem portion 19. The upper jaw portion 17 is frequently formed of the same material, such as cast iron-containing material, as is the handle 13. If desired, of course, the upper jaw portion can be formed of non-sparking material, such as cast aluminum or cast magnesium. Heretofore, the plastics have not been available that have adequate strength for forming the respective elements of the pipe wrench, although this may change with the advent of newer and better plastics.

The stem portion 19 has a first portion 21 of a holding means in the form of respective teeth along the sides of the stem portion 19. These "rack-like" stem teeth are disposed along the side surfaces to facilitate holding a desired attained position, when it is achieved, as will be more clearly apparent from the operational discussion hereinafter. If desired, the respective teeth in the first portion 21 of the holding means may have a slight angle such as angle alpha shown in FIG. 6*c* for the co-engaging teeth. With the teeth on the side of the stem portion 19 and comprising the first portion 21 in the illustrated embodiment of the holding means there will be an inverse angle to facilitate engagement of the respective teeth. The angle alpha is preferably small, ordinarily in the range of 2 degrees-4 degrees; for example, about 3 degrees.

The sleeve portion 23 is integrally formed with the handle in the illustrated embodiment. Ordinarily the sleeve portion 23 is simply a tunnel defined by the material of which the handle is formed, wrapped around it so that the stem portion 19 is slidably disposed therewithin. It is conventional and need not be described in great detail herein. The sleeve portion 23 is a part of a conventional wrench handle and need not be retrofitted separately if a retrofit kit is employed.

The raised shoulder portion 25 comprises simply two raised portions on each respective side of the handle 13 and define the slider block clearance space 27 adjacent the sleeve portion 23. The shoulder portions 25 are conventional, and integrally formed with the handle 13 and need not be described in great detail herein. It is sufficient to note that they are disposed on either side and define between themselves a valley through which the stem portion 19 can slide. The shoulders 25 are integral formed with and of the same material as the handle 13. Consequently, the shoulder portion need not be a part of a retrofit kit if such be employed.

The slider block clearance space 27 is simply a space between the shoulders 25 and the sleeve 23 and is adapted to hold in place the slider block forming the second portion 29 of the holding means.

Expressed otherwise, the second portion 29 of the holding means is in the form of a slider block, illustrated in FIGS. 1, 2*c* and 7*a–e* and the bell crank shaped dogs, or pawls, encompassed therewithin, as illustrated in FIGS. 3–6*d*.

Any second portion that is compatible with the first portion and will hold an attained position can be employed. The second portion is adapted to engage the stem portion 19 along its sides for holding the stem portion in an attained position of the first jaw with respect to the second jaw, or the upper jaw with respect to the lower jaw.

Figure 3:
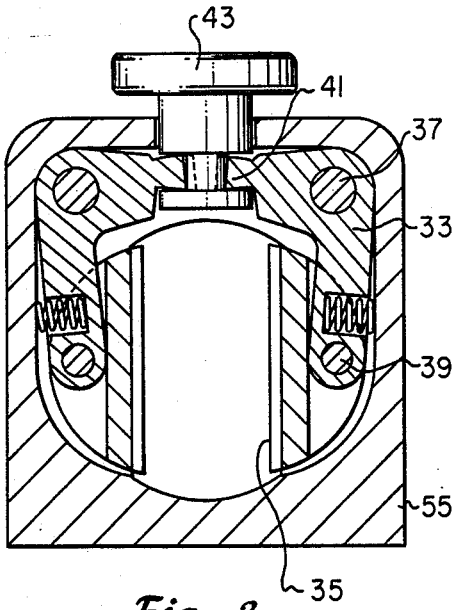
FIG. 3 is a an internal view of the bell crank structure of the pivotally mounted dogs having mating teeth blocks on respective sides, together with the biasing means.
Figure 4:
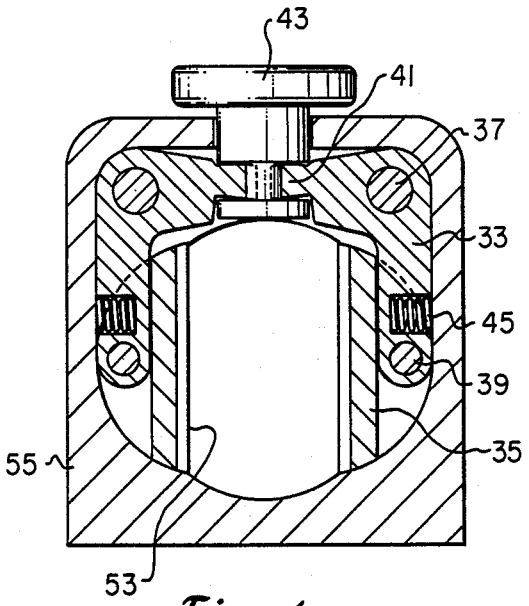
FIG. 4 is an illustrated view of the assembled buttons, levers and blocks of FIG. 3 interiorly of the push-button block, which is shown schematically.
Figure 5A:
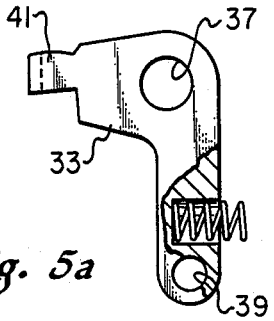
FIG. 5*a* is an elevational view of a bell crank dog of FIG. 3.
Figure 5B:
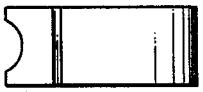
FIG. 5*b* is a top view of the bell crank dog of FIG. 5*a*.
Figure 5C:
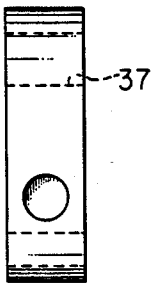
FIG. 5*c* is a side view of the bell crank dog of FIG. 5*a*.

In the illustrated embodiments where the first portion of the holding means comprises teeth along the side of the stem, the second portion 29 of the holding means will include pivotally mounted dogs, or pawls, 33, FIG. 3; including teeth blocks 35, FIGS. 3 and 6*a–c* for co-engaging the teeth of the first portion 21 along the sides of the stem 19. The dogs 33 are in the form of a 90 degree bell crank and are pivotally mounted for pivotal movement about a center shaft 37, FIGS. 3, 4, and 5*a–c*. Expressed otherwise, the 90 degree bell cranks, or the dogs 33, have their free ends 39 at which are pivotally mounted the respective teeth blocks 35, as will be clear by looking at FIGS. 6*a–d*. The other ends 41 form the depressing end of the dogs and can be depressed by the releasing means in the form of the button 43.

Figure 6A:
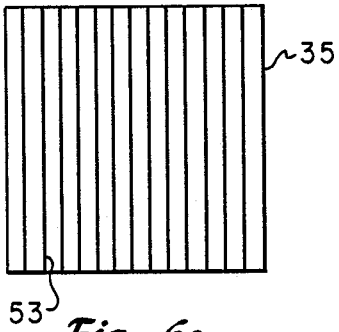
FIG. 6*a* is a front elevational view of the tooth block that is carried by the bell crank dog.
Figure 6B:
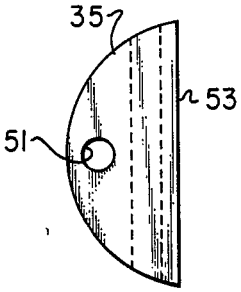
FIG. 6*b* is a side view of a tooth block of FIG. 6*a*.
Figure 6C:
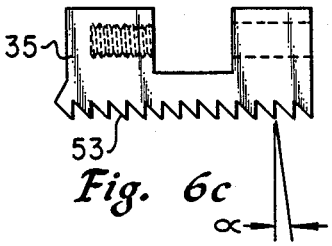
FIG. 6*c* is a top view of the tooth block of FIG. 6*a*.
Figure 6D:
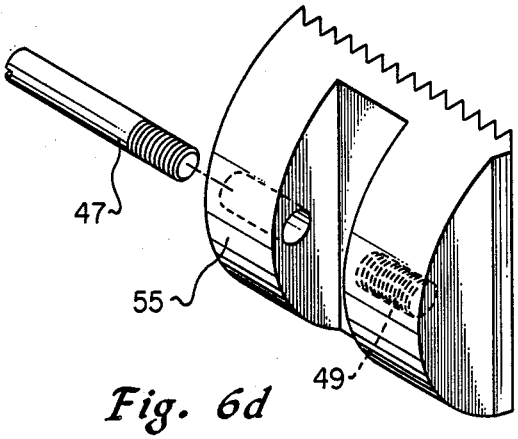
FIG. 6*d* illustrates a mounting block for pivotally holding the teeth block in place.
Figure 7B:
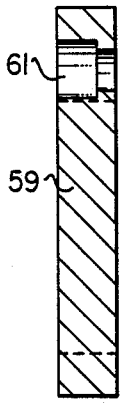
FIG. 7*b* is a cross-sectional view of the cap place of the push-button block housing showing the recess for receiving a screw-bolt, or stud bolt, to hold the push-button block assembled with the dogs pivotally mounted therewithin.
Figure 7A:
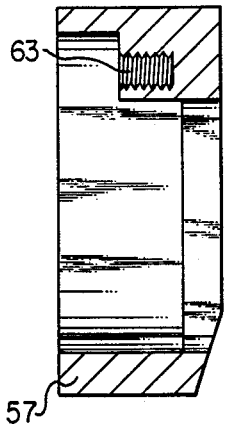
FIG. 7*a* is a cross-sectional view of the push-button block housing along one side.
Figure 7D:
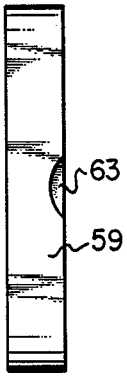
FIG. 7*d* is a top view of the push-button cap plate of FIG. 7*b*.
Figure 7C:
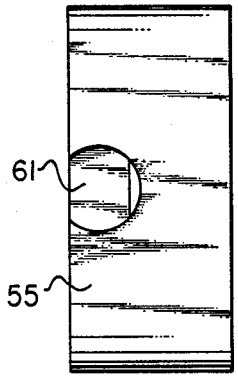
FIG. 7*c* is a top view of the push-button block housing of FIG. 7*a*.
Figure 7E:
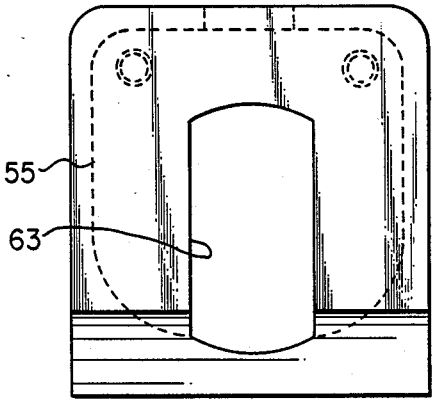
FIG. 7*e* is an end view of the push-button block housing with an aperture for slidably receiving the stem of the upper jaw.

A biasing means in the form of respective coil springs 45, effect pivotal movement to place the teeth of the teeth blocks 35 into engagement with the first portion, or teeth along the sides of the stem portion 19. The coil springs 45 are encompassed within cylindrical recesses to keep them retained in place. If desired, of course, suitable recesses can be employed in the side walls of the slider block forming a second portion 29 of the holding means. It has been found that such depression in the side walls are not necessary, since the coil springs tend to remain in position when the dogs are emplaced within the slide block housing. As illustrated in FIGS. 6*a–c*, the teeth block 35 are in the form of a portion of a circle and are adapted to be pivotally held in place, as along a pin shaft 47, FIG. 6*d* that can be threadedly inserted though a suitable aperture 49 for holding each tooth block in place through its aperture 51, FIG. 6*b*. As illustrated in FIG. 6*c*, the respective teeth 53 have an angle alpha for co-engaging the teeth along the sides of the stem portion 19. The screw shaft 47 may have any type of head 55 desired. As illustrated, it is a screw head so as to be screwed into its aperture by suitable conventional screwdriver. If desired, the head can be in the form of a Phillips-head, an Allen-head, as for an Allen-head wrench, or the like. The teeth blocks have relative freedom for pivotal movement to engage the teeth in the teeth blocks with the teeth on the stem portion even when there is no exact alignment. This facilitates holding of an attained position by the operator when the jaws are slid toward each other to engage the object, such as a pipe.

The slider block 55 forming the second portion 29 of the holding means, is formed in two parts. The first part is a housing 57, FIG. *7a* and a cap plate 59, FIG. *7b*. As can be seen in this cross-sectional view taken along the side of the push-button block, the cap plate 59 has an aperture 61 through which a screw bolt is inserted. A threaded aperture 63 is provided in the housing 57 for receiving the screw bolt and holding the cap plate 59 in place. The screw bolt can also serve as the pivot shaft 37 to retain the dogs pivotally mounted.

The top of the push-button block housing is illustrated in FIGS. *7c* and *7d*. Therein, the push-button block housing 55 has a recess 61 for receiving the push-button 43 when it is depressed. A small portion of the recess 63 is illustrated in FIG. *7d* where the top of the cap plate 59 is adapted to receive the push-button 43 when it is depressed to release the slidable jaw 17 and stem portion 19.

Referring to *7e*, the push-button slider block 55 shows interiorly thereof a tunnel 63 slidably receiving the stem 19 of the upper jaw 17.

The stem portion is retained in place within the sleeve portion 23 and the push-button block simply forms a portion of the holding means to hold an attained position that can be achieved readily by an operator.

In operation, the formed, or assembled wrench 11 is fit to the article to be grasped such as a pipe and the upper jaw 17 is moved toward the lower jaw 15 until a desired fit is attained. Once the fit is attained, the push-button 43 which will have been depressed to move the dogs laterally and disengage the teeth from the sides of the stem portion 19, is released. This allows the teeth 53 of the teeth blocks interiorly of the push-button block to engage the sides of the stem portion 19 responsive to force from the coil spring 45 serving as the biasing means. In this way, an attained position is held and the desired force may be put on the handle for making a connection or breaking a connection, as by rotating a pipe or the like. Thereafter, the push-button 43 can be pushed to release the jaw and it moved to a desired portion, such as upwardly for releasing the pipe wrench from engagement with the pipe.

In this application, the term upwardly and lower is used with respect to the lower jaw being on then lower portion or next to the handle whereas the upper jaw 17 is above the lower jaw 15 when the wrench is vertical with the handle downward.

It is believed clear how the depression end 41 of the bell crank 90 degrees pawls, or dogs, 33, are depressed inwardly by the depression of the push-button 43 to move the teeth blocks 35 outwardly and effect disengagement with the sides of the stem portion 19. It is also believed clear how the re-engagement works by releasing of the push-button 43 when a desired position is attained.

From the foregoing, it can be seen that this invention accomplishes the objects delineated hereinbefore and, more particular, enables a user, or operator, to attain a position grippingly engaging and object such as a pipe to be rotated by the wrench.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A pipe wrench comprising:

a. a handle with a stationary lower jaw portion;

b. a movable upper jaw with depending stem portion extending downwardly along the backside of said handle;

c. first portion of a holding means for holding an attained position of said stem portion with respect to said lower jaw portion; said first portion of said holding means including rack-like stem teeth disposed along the sides of said stem portion, with the front and back surfaces of said stem portion being substantially smooth;

d. a sleeve rigidly connected with said handle below said lower jaw; said sleeve having space for said stem portion to pass slidably therethrough;

e. an upwardly protruding shoulder disposed below said sleeve portion;

f. a slider block clearance space between said shoulder an said sleeve portion;

g. a second portion of said holding means for achieving an attained position; said second portion being adapted to engage said stem portion along its sides for holding said stem portion in an attained position of said upper jaw with respect to said lower jaw; said second portion of said holding means including a slider block having a pair of pivotally mounted dogs, each containing mating teeth blocks adapted to co-engage said teeth along the sides of said stem portion when allowed to return to the normal engaging position; said dogs being of a bell crank design such that depression of a push-button release means at one end of the bell crank causes the other end to move outwardly laterally from said stem teeth to disengage said teeth from the sides of said stem portion when depressed; and h. releasing means for releasing said stem portion from said second portion of said holding means; said releasing means being adapted to move said second portion of said holding means out of engagement with the sides of said stem when depressed to effect release; said releasing means comprising said push-button release means adapted to release said teeth blocks and move them out of engagement with the teeth of said stem portion when depressed to effect release; and wherein there is a biasing means disposed on said dogs so as to bias said dogs to their normal engaging position;

whereby an operator can depress said releasing means and quickly and easily attain a desired fit with said wrench.

* * * * *